US006729208B1

(12) United States Patent
Chrzanowski

(10) Patent No.: US 6,729,208 B1
(45) Date of Patent: May 4, 2004

(54) TOOL FOR REMOVING FASTENERS

(75) Inventor: Joe Chrzanowski, Tomah, WI (US)

(73) Assignee: AJ Manufacturing Co., Inc., Elmhurst, IL (US)

( * ) Notice: Subject to any disclaimer, the term of this patent is extended or adjusted under 35 U.S.C. 154(b) by 0 days.

(21) Appl. No.: 10/282,477

(22) Filed: Oct. 29, 2002

(51) Int. Cl.[7] ..... B25B 13/50
(52) U.S. Cl. ..... 81/53.2; 81/121.1; 81/120
(58) Field of Search ..... 81/53.2, 120, 121.1, 81/124.6, 125, 186

(56) References Cited

U.S. PATENT DOCUMENTS

| | | | | |
|---|---|---|---|---|
| 906,040 | A | | 12/1908 | Lucas |
| 1,478,736 | A | | 12/1923 | Gadberry |
| 1,590,200 | A | | 6/1926 | McGuckin |
| 2,391,624 | A | | 12/1945 | Heuer |
| 2,896,985 | A | | 7/1959 | Braatz |
| 3,079,819 | A | | 3/1963 | Wing |
| 3,125,910 | A | | 3/1964 | Kavalar |
| 3,161,090 | A | | 12/1964 | McLellan |
| 3,675,516 | A | | 7/1972 | Knudsen et al. |
| 3,788,169 | A | | 1/1974 | Nakayama |
| 3,885,480 | A | | 5/1975 | Muenchinger |
| 3,903,764 | A | | 9/1975 | Andersen |
| 3,996,819 | A | | 12/1976 | King |
| 4,328,720 | A | | 5/1982 | Shiel |
| 4,452,060 | A | | 6/1984 | Kanamaru et al. |
| 4,598,616 | A | | 7/1986 | Colvin |
| 4,611,513 | A | | 9/1986 | Young et al. |
| 4,671,141 | A | | 6/1987 | Hanson |
| 4,724,730 | A | | 2/1988 | Mader et al. |
| 4,862,976 | A | | 9/1989 | Meek |
| 4,882,957 | A | | 11/1989 | Wright et al. |
| 4,930,378 | A | | 6/1990 | Colvin |
| 4,947,712 | A | | 8/1990 | Brosnan |
| 5,012,706 | A | | 5/1991 | Wright et al. |
| 5,048,379 | A | | 9/1991 | Gramera et al. |
| 5,207,132 | A | | 5/1993 | Goss et al. |
| 5,284,073 | A | | 2/1994 | Wright et al. |
| 5,551,320 | A | | 9/1996 | Horobec et al. |
| D398,823 | S | | 9/1998 | Hsieh |
| 5,813,298 | A | | 9/1998 | Beattie |
| 5,904,076 | A | | 5/1999 | Siwy |
| 5,910,197 | A | | 6/1999 | Chaconas |
| 5,931,064 | A | | 8/1999 | Gillespie |
| 5,960,681 | A | * | 10/1999 | Anderson et al. ..... 81/125 |
| 6,029,547 | A | | 2/2000 | Eggert et al. |
| 6,047,620 | A | | 4/2000 | Kozak et al. |
| 6,198,049 | B1 | | 3/2001 | Korinek |
| 6,240,813 | B1 | | 6/2001 | Hyatt |
| 6,267,025 | B1 | * | 7/2001 | Sand et al. ..... 81/53.2 |
| 6,282,994 | B1 | | 9/2001 | Wei |
| 6,321,623 | B1 | | 11/2001 | Dykes et al. |
| 6,321,625 | B1 | | 11/2001 | Fernandez |

(List continued on next page.)

*Primary Examiner*—Lee D. Wilson
(74) *Attorney, Agent, or Firm*—Thomas J. Ring; Wildman, Harrold, Allen & Dixon LLP

(57) ABSTRACT

A tool for removing threaded members, such as fasteners, damaged by corrosion or mechanical stress. The tool includes a first end and a second end opposite the first end. A generally annular body extends between the first and second ends and includes an inner wall. A drive engaging portion is positioned intermediate the first and second ends and is adapted for cooperating with a drive mechanism. A series of spiral flutes is formed along the inner wall of the annular body so as to provide a corresponding series of spiral crests extending along the inner wall. Proceeding from an end of the tool in a direction toward the drive engaging portion, the flutes and crests taper inward toward a central longitudinal axis extending through the annular body. When the tool is placed onto a fastener, the crests bite into an outer surface of the fastener to engage the fastener, thereby facilitating application of torque to the fastener to facilitate its removal.

19 Claims, 3 Drawing Sheets

U.S. PATENT DOCUMENTS 6,339,976 B1 * 1/2002 Jordan ..... 81/53.2
6,354,175 B1 3/2002 Dobson et al.
6,382,053 B1 5/2002 Macor
6,397,706 B1 6/2002 Maznicki
6,598,498 B1 * 7/2003 Pigford et al. ..... 81/53.2
2002/0011135 A1 1/2002 Hall
2002/0023521 A1 2/2002 Dobson et al.

* cited by examiner

FIG. 1
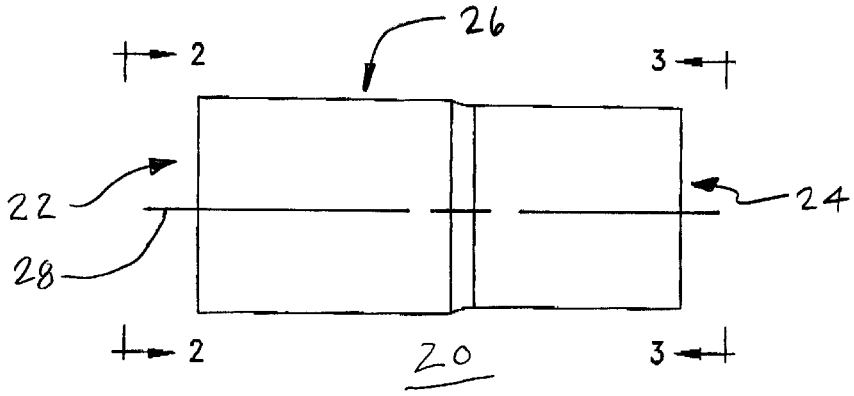
FIG. 2
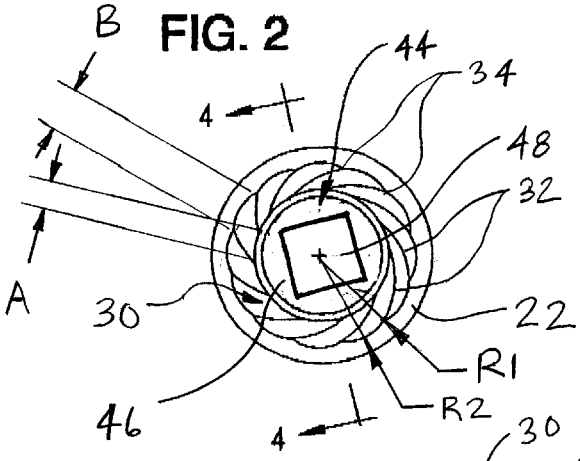
FIG. 3
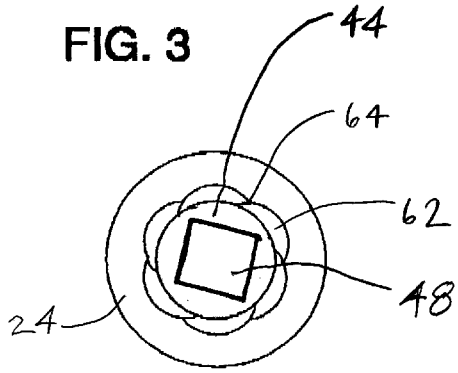
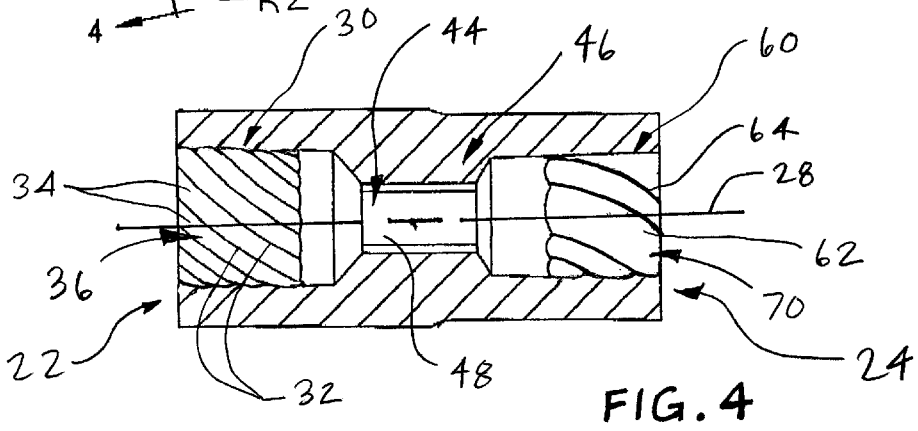
FIG. 4

TOOL FOR REMOVING FASTENERS

FIELD OF THE INVENTION

The present invention relates to tools for removing threaded members, such as fasteners and, more particularly, threaded members damaged by corrosion or mechanical stress such that corners of head portions of the threaded member have become rounded or abraded.

BRIEF DESCRIPTION OF THE DRAWINGS

The presently disclosed invention is shown and described in connection with the accompanying drawings wherein:

FIG. 1 is a side view of the tool of the present invention;

FIG. 2 is an end view of a first end of the tool of FIG. 1;

FIG. 3 is an end view of a second end of the tool of FIG. 1;

FIG. 4 is a side cross-sectional view along line 4—4 of FIG. 2;

DETAILED DESCRIPTION

Figure 5:
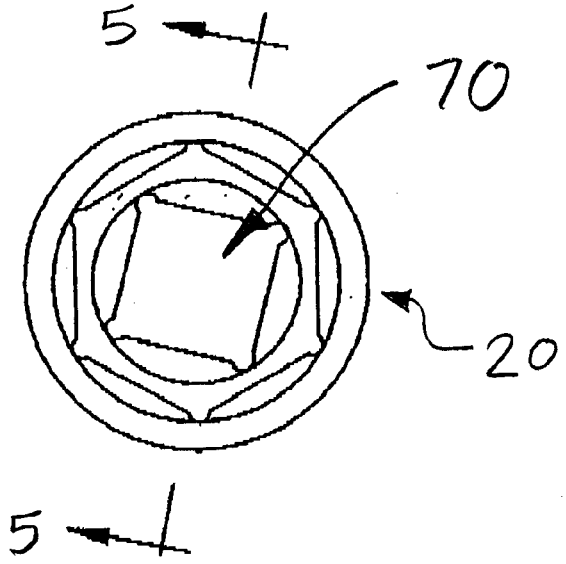
FIG. 5 is an end view of an alternative embodiment of the second end of the tool of FIG. 3.

Referring to FIG. 1, tool 20 includes a first end 22, a second end 24 opposite first end 22, and a generally annular body 26 extending between first end 22 and second end 24. Body 26 has a central longitudinal axis 28.

As seen in FIGS. 2 and 4, annular body 26 has an inner wall 30 which includes a series of generally spiral tapered flutes 34 formed therein so as to produce a corresponding series of generally spiral crests 32, one of crests 32 being formed along either side of each of flutes 34 and extending along inner wall 30 from first end 22 into an interior portion of annular body 26. In the presently described embodiment, crests 32 and flutes 34 have a left-hand twist configuration. However, it will be apparent to those skilled in the art that crests and flutes formed on inner wall 30 may alternatively have a right-hand twist configuration.

Crests 32 and adjoining flutes 34 combine to define an opening 36 extending into annular body 26 from first end 22 toward an interior portion of body 26. As seen in FIG. 2, crests 32 and corresponding flutes 34 taper toward body longitudinal axis 28 such that a cross-sectional area of opening 36 taken orthogonally to center axis 28 decreases along a direction extending from first end 22 toward second end 24 of body 26. Along any plane taken orthogonally to center axis 28, a radial distance R1 of each point on crest 32 from longitudinal center axis 28 is less than a radial distance R2 from the axis of a point on an adjacent flute 34. As flutes 34 are concave with respect to longitudinal axis 28, crests 32 form innermost engagement surfaces of tool 20 within opening 36. It may also be seen that, as crests 32 taper inward toward longitudinal axis 28, a separation distance A between adjacent crests proximate a drive engaging portion 44 of the tool (to be described in detail later) is less than a separation distance B between the adjacent crests proximate first end 22 as shown in FIG. 2. The spiral configuration of crests 32 may extend along the entire lengths of the crests.

Tool 20 also includes a drive engaging portion, generally designated 44, adapted for cooperating with a drive mechanism, such as a handle or an extension rod, for use in rotating tool 20. In the presently described embodiment, drive engaging portion 44 is positioned within an interior portion of body 26 as shown in FIGS. 2, 3 and 4 and comprises a wall 46 traversing opening 36 into body 26. Wall 46 includes a square through hole 48 that is adapted to receive a drive pin of a ratchet or other lever (not shown). It will be apparent that through hole 48 may have any one of several alternative shapes as desired. In an alternative embodiment, drive engaging portion 44 may include a blind cavity instead of a through hole for receiving the d rive mechanism.

It may be seen from FIG. 4 that crests 32 and flutes 34 extend along inner wall 30 between first end 22 and drive engaging portion 44. Crests 32 and flutes 34 generally terminate at or proximate drive engaging portion 44. In an alternative embodiment (not shown), drive engaging portion 44 may be formed on an exterior surface of body 26 if required by, for example, forming a hexagonal portion on an external surface of body 26.

Figure 6:
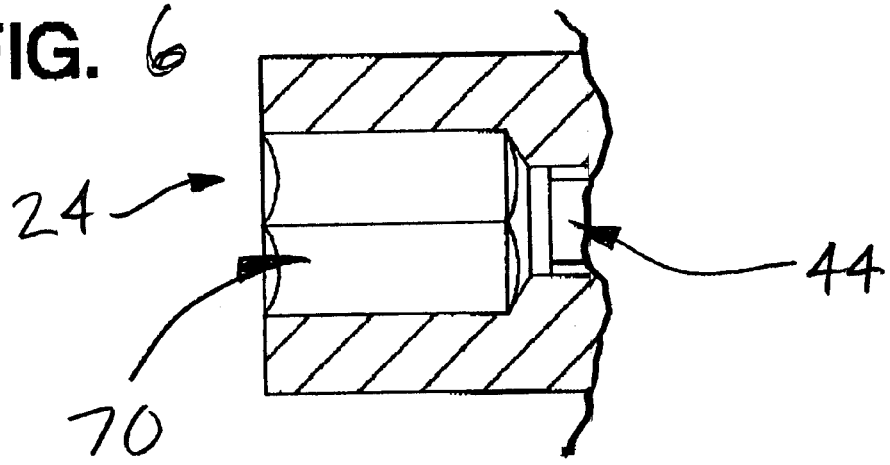
FIG. 6 is a partial cross-sectional view along line 5—5 of the alternative embodiment of FIG. 5.

Second end 24 of tool 20 may be configured in any one of a variety of ways to meet the projected needs of a user. In one embodiment, tool second end 24 may be configured similar to first end 22, annular body 26 having a second inner wall 60 which includes a series of generally spiral flutes 62 extending therealong from second end 24 into an interior portion of annular body 26 so as to form a generally spiral crest 64 on either side of each of flutes 62, also extending along second inner wall 60 adjacent corresponding ones of flutes 62. Crests 62 and flutes 64 may have either a left-hand twist configuration or a right-hand twist configuration. Alternatively, as seen in FIGS. 5 and 6, second inner wall 60 may be formed so as to define a polygonal opening 70 adapted for receiving a correspondingly-shaped undamaged polygonal threaded member therein. For example, opening 70 may be sized to receive either a standard English-size fastener of a standard metric-size fastener.

Figure 7:
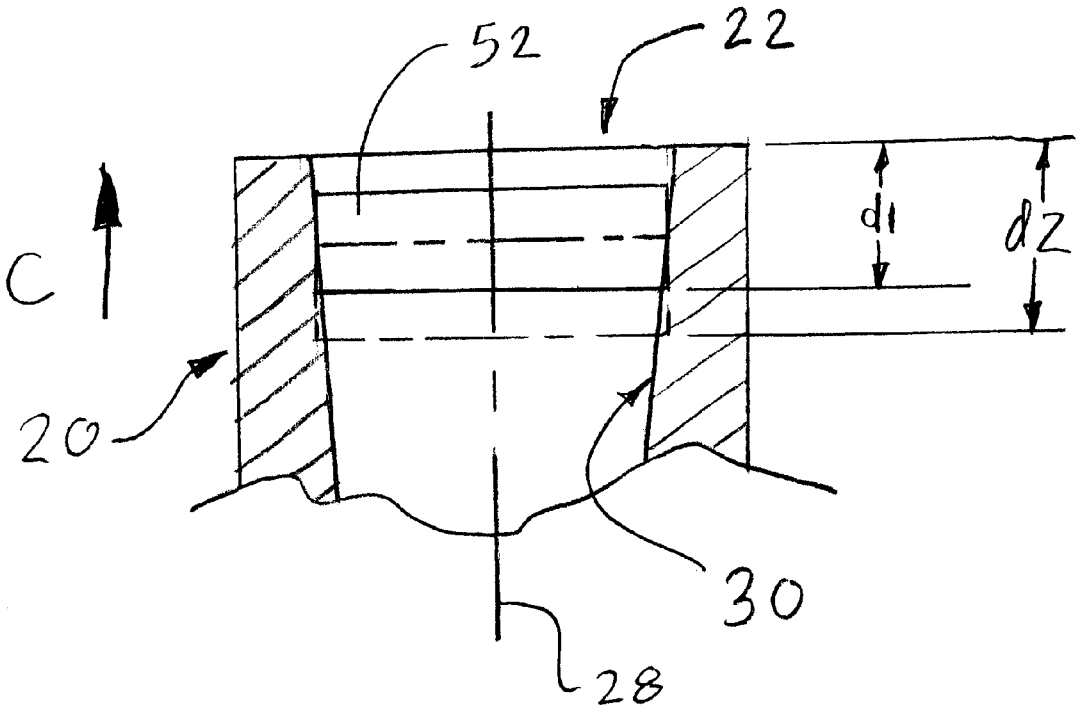
FIG. 7 is a partial cross-sectional schematic view of the tool of FIG. 1 engaging a fastener.

The operation of tool 20 will now be described. In use, tool 20 is placed over a fastener 52 or other threaded member that is to be removed. Referring to FIG. 7, which is a schematic representation of a portion of tool 20 in which the crests and flutes are not shown, tool 20 is positioned on fastener 52 such that tool first end 22 passes over an outside perimeter of the fastener and crests 32 along inner wall 30 (FIG. 4) engage the fastener. Referring to FIGS. 2 and 4, as flutes 34 are concave with respect to longitudinal axis 28, crests 32 form innermost engagement surfaces of tool 20 within opening 36, and as the radial distance R1 of each point along crest 32 from longitudinal center axis 28 is less than the radial distance R2 of any point along any corresponding flute 34 from the axis, crests 32 form a cutting edge which bites into an abutting surface of fastener 52 when tool 20 is placed over fastener 52 and rotated in a direction required to loosen the fastener. The taper of the crests and the distribution of the crests around inner wall 30 enable tool 20 to engage and grip and draw down on threaded members which are irregularly shaped or damaged due to, for example, stripping during previous attempts at removal.

When torque is applied to tool 20 through a ratchet or other lever that is coupled to drive engaging portion 44, this torque is transferred to the fastener through any of crests 32 in contact with the fastener, thereby facilitating removal of the fastener. As seen in FIGS. 4 and 7, the taper of the crests enables crests 32 to bite more deeply into the fastener as tool 20 is pressed onto the fastener in a direction indicated by arrow C. For example, crests 32 bite more deeply into an outer surface of fastener 52 as the fastener is forced deeper into opening 36 from a lesser depth d1 to a greater depth d2 from first end. As shown in FIG. 7, fastener 52 is represented by a solid line at the lesser depth d1 and represented by a phantom line at the greater depth d2. In addition, as seen from FIG. 8, the spiral configuration of each crest 32 provides an engagement length L (and, thus, more engagement area) between the fastener and the crest that is greater than an engagement length L' which would be provided by a straight crest configuration (i.e., a hypothetical crest 32' having an orientation generally parallel to longitudinal axis 28). These features enable the fastener to be gripped more securely and allow a greater torque to be applied to the fastener. In other embodiments, the number of flutes and, correspondingly, the number of crests may be increased to provide an even greater engagement area.

It should be understood that the preceding is merely a detailed description of one embodiment of this invention and that numerous changes to the disclosed embodiment can be made in accordance with the disclosure herein without departing from the spirit or scope of the invention. The preceding description, therefore, is not meant to limit the scope of the invention. Rather, the scope of the invention is to be determined only by the appended claims and their equivalents.

What is claimed is:

1. A tool for removing fasteners comprising:

a first end;

a second end opposite the first end;

a generally annular body extending between the first and second ends and having a longitudinal axis;

a drive engaging portion intermediate the first and second ends for cooperating with a drive mechanism;

the annular body having an inner wall including a plurality of generally spiral flutes extending between the first end and the drive engaging portion, a plurality of generally spiral crests, a crest being located on either side of each flute, the plurality of flutes and the plurality of crests combining to define an opening into the annular body from the first end, the plurality of flutes and the plurality of crests tapering toward the body longitudinal axis such that a cross-sectional area of the opening taken orthogonally to the longitudinal center axis decreases along a direction extending from the first end toward the second end of the body.

2. The tool of claim 1, wherein the drive engaging portion is positioned within the opening.

3. The tool of claim 1 wherein the drive engaging portion comprises a wall traversing the opening into the body.

4. The tool of claim 3 wherein the wall includes a hole for engaging a drive tool.

5. The tool of claim 4 wherein the hole is a square hole.

6. The tool of claim 1 wherein the crests are disposed in a generally circular arrangement along the inner wall of the body.

7. The tool of claim 1 wherein each crest has a spiral configuration centered about the longitudinal axis.

8. The tool of claim 1 wherein the opening into the body extends through the body between the first and second ends of the tool.

9. The tool of claim 1 wherein the spiral crests exhibit a left-hand twist.

10. The tool of claim 1 wherein the spiral crests exhibit a right-hand twist.

11. The tool of claim 1 further comprising a second inner wall extending between the tool second end and the drive engaging portion, the second inner wall including a plurality of generally spiral flutes extending between the second end and the drive engaging portion, a plurality of generally spiral crests, a crest being located on either side of each flute, the plurality of flutes and the plurality of crests combining to define an opening into the annular body from the second end, the plurality of flutes and the plurality of crests tapering toward the body longitudinal axis such that a cross-sectional area of the opening taken orthogonally to the longitudinal center axis decreases along a direction extending from the second end toward the first end of the body.

12. The tool of claim 11 wherein the spiral crests exhibit a left-hand twist.

13. The tool of claim 11 wherein the spiral crests exhibit a right-hand twist.

14. The tool of claim 1 further comprising a second inner wall extending between the tool second end and the drive engaging portion, the second inner wall defining a polygonal opening adapted for receiving a correspondingly-shaped polygonal threaded member therein.

15. The tool of claim 14 wherein the opening is generally hexagonal.

16. The tool of claim 14 wherein the opening is sized to receive an English-sized threaded member therein.

17. The tool of claim 14 wherein the opening is sized to receive an metric-sized threaded member therein.

18. The tool of claim 1 wherein the spiral configuration of the flutes extends along substantially the entire length of the flute.

19. A tool for removing fasteners comprising:

a first end;

a second end opposite the first end;

a generally annular body extending between the first and second ends and having a longitudinal axis;

a drive engaging portion intermediate the first and second ends for cooperating with a drive mechanism;

the annular body having an inner wall including a plurality of generally spiral crests extending between the first end and the drive engaging portion, the plurality of crests defining an opening into the annular body from the first end and tapering toward the body longitudinal axis such that a separation distance between adjacent crests proximate the drive engaging portion is less than a separation distance between the adjacent crests proximate the first end.

* * * * *

UNITED STATES PATENT AND TRADEMARK OFFICE

CERTIFICATE OF CORRECTION

PATENT NO. : 6,729,208 B1 
DATED : May 4, 2004
INVENTOR(S) : Joe Chrzanowski

It is certified that error appears in the above-identified patent and that said Letters Patent is hereby corrected as shown below:

Drawings,

Figs. 1-4 now appear on sheet 1 of 2 of the drawings:

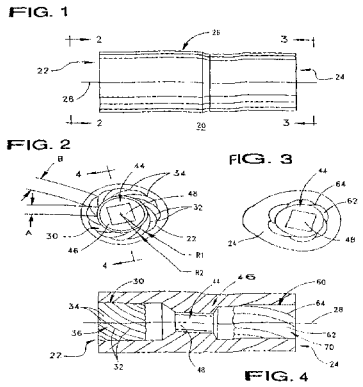

Figs. 5-8 now appear on sheet 2 of 2 of the drawings:

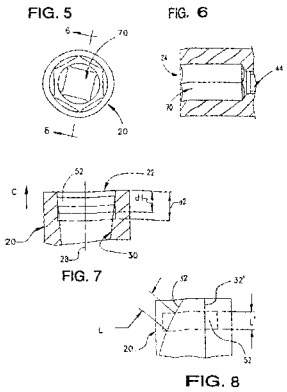

Signed and Sealed this

Thirty-first Day of August, 2004

JON W. DUDAS
*Director of the United States Patent and Trademark Office*

UNITED STATES PATENT AND TRADEMARK OFFICE

CERTIFICATE OF CORRECTION

PATENT NO. : 6,729,208 B1
DATED : May 4, 2004
INVENTOR(S) : Joe Chrzanowski

It is certified that error appears in the above-identified patent and that said Letters Patent is hereby corrected as shown below:

Drawings,
Figs. 1-4 now appear on sheet 1 of 2 of the drawings:
Figs. 5-8 now appear on sheet 2 of 2 of the drawings:

This certificate supersedes Certificate of Correction issued August 31, 2004.

Signed and Sealed this

Thirtieth Day of November, 2004

JON W. DUDAS
*Director of the United States Patent and Trademark Office*

FIG. 1
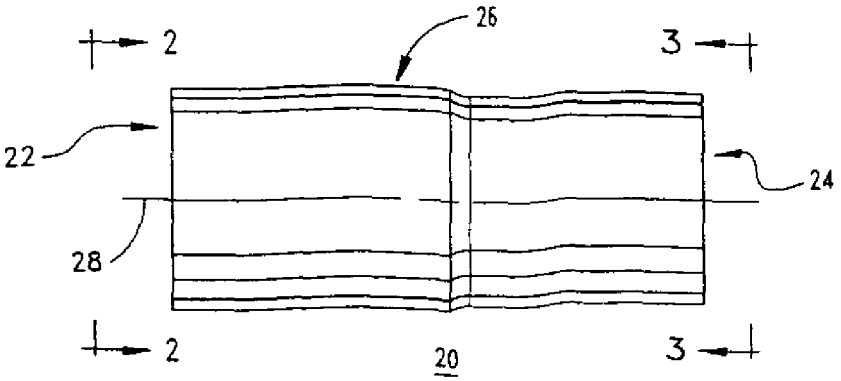
FIG. 2
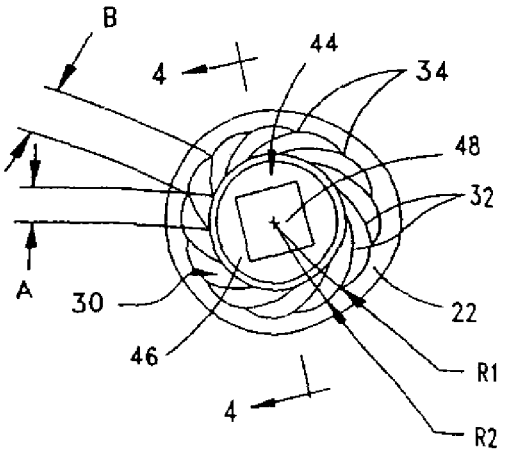
FIG. 3
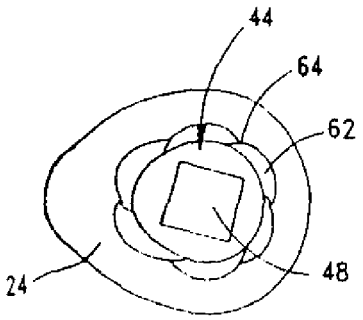
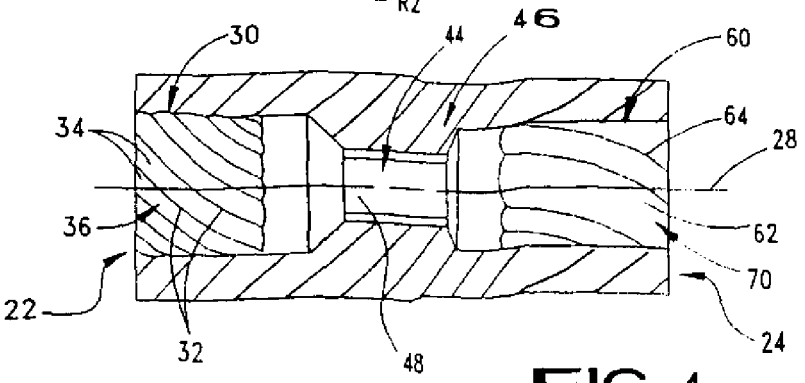
FIG. 4

Figure 8:
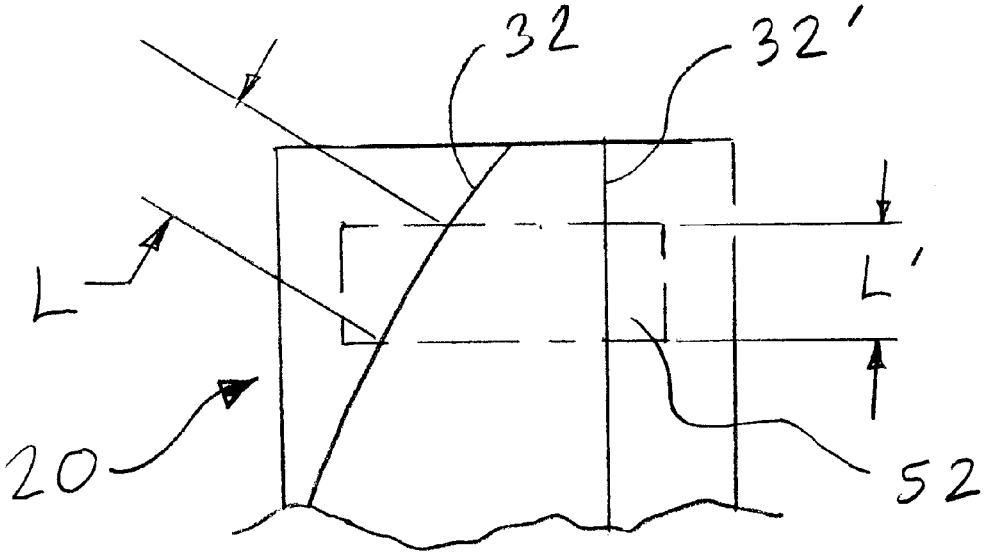
FIG. 8 is a partial side schematic view of the tool of FIG. 1 engaging a fastener.
Figure 5:
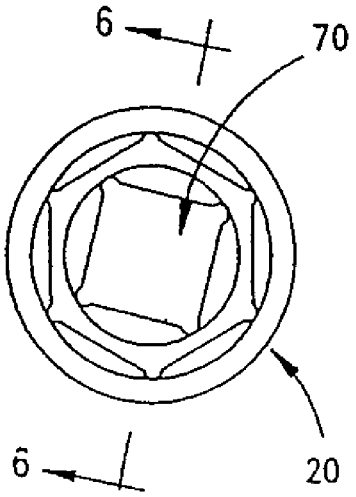
Figure 6:
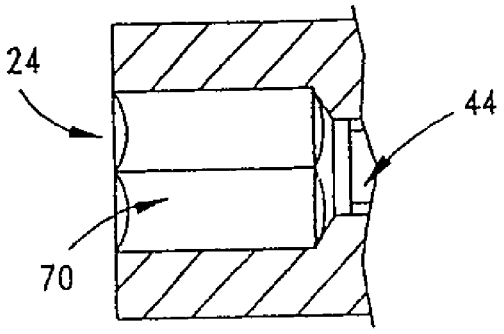
Figure 7:
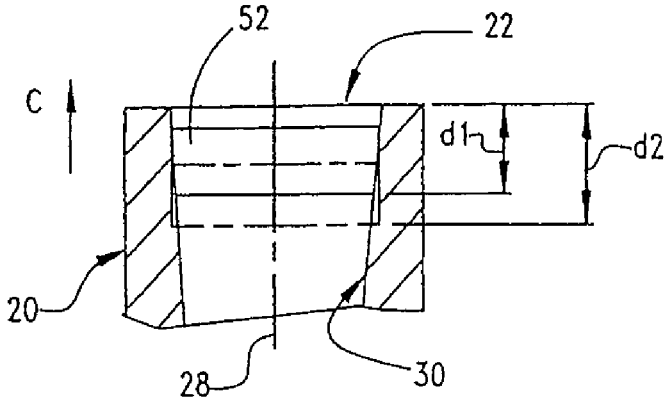
Figure 8:
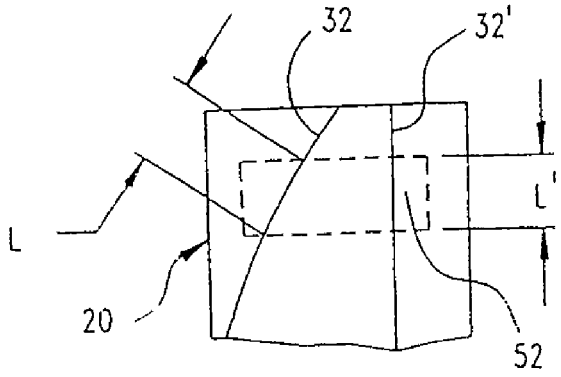

FIG. 5
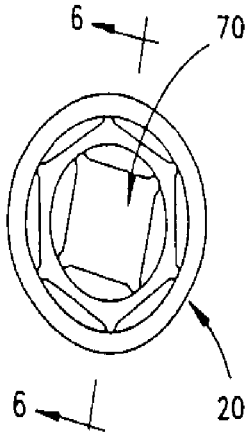
FIG. 6
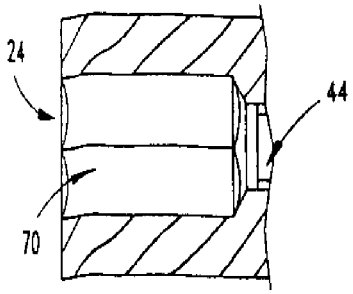
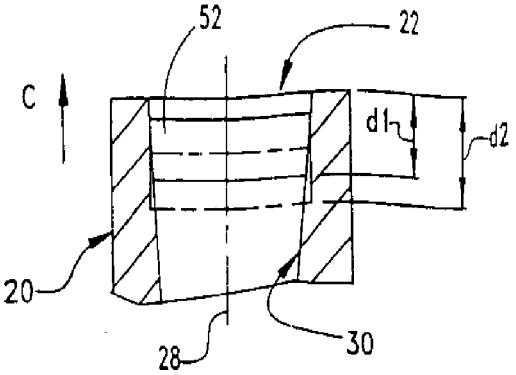
FIG. 7
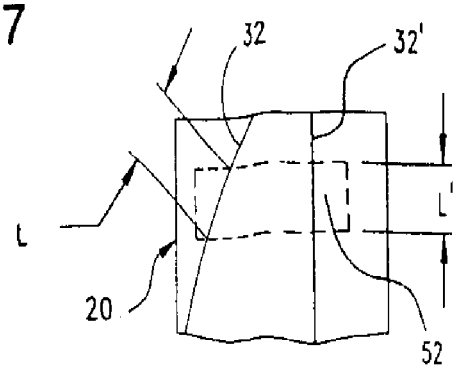
FIG. 8

UNITED STATES PATENT AND TRADEMARK OFFICE

CERTIFICATE OF CORRECTION

PATENT NO. : 6,729,208 B1
APPLICATION NO. : 10/282477
DATED : May 4, 2004
INVENTOR(S) : Joe Chrzanowski It is certified that error appears in the above-identified patent and that said Letters Patent is hereby corrected as shown below:

Delete title page and substitute therefor the attached title page.

Delete Drawing Sheets 1-3 and substitute therefor the attached Drawing Sheets 1-3.

This certificate supersedes Certificate of Corrections issued August 31, 2004 and November 30, 2004.

Signed and Sealed this

Fifth Day of June, 2007

JON W. DUDAS
*Director of the United States Patent and Trademark Office*

(12) United States Patent
Chrzanowski

(10) Patent No.: US 6,729,208 B1
(45) Date of Patent: May 4, 2004

(54) TOOL FOR REMOVING FASTENERS

(75) Inventor: Joe Chrzanowski, Tomah, WI (US)

(73) Assignee: AJ Manufacturing Co., Inc., Elmhurst, IL (US)

( * ) Notice: Subject to any disclaimer, the term of this patent is extended or adjusted under 35 U.S.C. 154(b) by 0 days.

(21) Appl. No.: 10/282,477

(22) Filed: Oct. 29, 2002

(51) Int. Cl.[7] ..... B25B 13/50
(52) U.S. Cl. ..... 81/53.2; 81/121.1; 81/120
(58) Field of Search ..... 81/53.2, 120, 121.1, 81/124.6, 125, 186

(56) References Cited

U.S. PATENT DOCUMENTS

| | | | |
|---|---|---|---|
| 906,040 | A | 12/1908 | Lucas |
| 1,478,736 | A | 12/1923 | Gadberry |
| 1,590,200 | A | 6/1926 | McGuckin |
| 2,391,624 | A | 12/1945 | Heuer |
| 2,896,985 | A | 7/1959 | Braatz |
| 3,079,819 | A | 3/1963 | Wing |
| 3,125,910 | A | 3/1964 | Kavalar |
| 3,161,090 | A | 12/1964 | McLellan |
| 3,675,516 | A | 7/1972 | Knudsen et al. |
| 3,788,169 | A | 1/1974 | Nakayama |
| 3,885,480 | A | 5/1975 | Muenchinger |
| 3,903,764 | A | 9/1975 | Andersen |
| 3,996,819 | A | 12/1976 | King |
| 4,328,720 | A | 5/1982 | Shiel |
| 4,452,060 | A | 6/1984 | Kanamaru et al. |
| 4,598,616 | A | 7/1986 | Colvin |
| 4,611,513 | A | 9/1986 | Young et al. |
| 4,671,141 | A | 6/1987 | Hanson |
| 4,724,730 | A | 2/1988 | Mader et al. |
| 4,862,976 | A | 9/1989 | Mock |
| 4,882,957 | A | 11/1989 | Wright et al. |
| 4,930,378 | A | 6/1990 | Colvin |
| 4,947,712 | A | 8/1990 | Brosnan |
| 5,012,706 | A | 5/1991 | Wright et al. |
| 5,048,379 | A | 9/1991 | Gramera et al. |
| 5,207,132 | A | 5/1993 | Goss et al. |
| 5,284,073 | A | 2/1994 | Wright et al. |
| 5,551,320 | A | 9/1996 | Horober et al. |
| D398,823 | S | 9/1998 | Hsieh |
| 5,813,298 | A | 9/1998 | Beattie |
| 5,904,076 | A | 5/1999 | Siwy |
| 5,910,197 | A | 6/1999 | Chaconas |
| 5,931,064 | A | 8/1999 | Gillespie |
| 5,960,681 | A * | 10/1999 | Anderson et al. ..... 81/125 |
| 6,029,547 | A | 2/2000 | Eggert et al. |
| 6,047,620 | A | 4/2000 | Kozak et al. |
| 6,198,049 | B1 | 3/2001 | Korinek |
| 6,240,813 | B1 | 6/2001 | Hyatt |
| 6,267,025 | B1 * | 7/2001 | Sand et al. ..... 81/53.2 |
| 6,282,994 | B1 | 9/2001 | Wei |
| 6,321,623 | B1 | 11/2001 | Dykes et al. |
| 6,321,625 | B1 | 11/2001 | Fernandez |

(List continued on next page.)

*Primary Examiner*—Lee D. Wilson
(74) *Attorney, Agent, or Firm*—Thomas J. Ring; Wildman, Harrold, Allen & Dixon LLP

(57) ABSTRACT

A tool for removing threaded members, such as fasteners, damaged by corrosion or mechanical stress. The tool includes a first end and a second end opposite the first end. A generally annular body extends between the first and second ends and includes an inner wall. A drive engaging portion is positioned intermediate the first and second ends and is adapted for cooperating with a drive mechanism. A series of spiral flutes is formed along the inner wall of the annular body so as to provide a corresponding series of spiral crests extending along the inner wall. Proceeding from an end of the tool in a direction toward the drive engaging portion, the flutes and crests taper inward toward a central longitudinal axis extending through the annular body. When the tool is placed onto a fastener, the crests bite into an outer surface of the fastener to engage the fastener, thereby facilitating application of torque to the fastener to facilitate its removal.

19 Claims, 3 Drawing Sheets

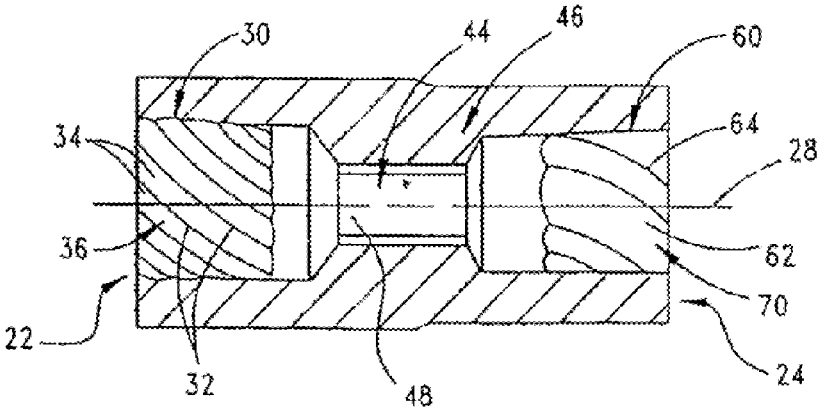

FIG. 1
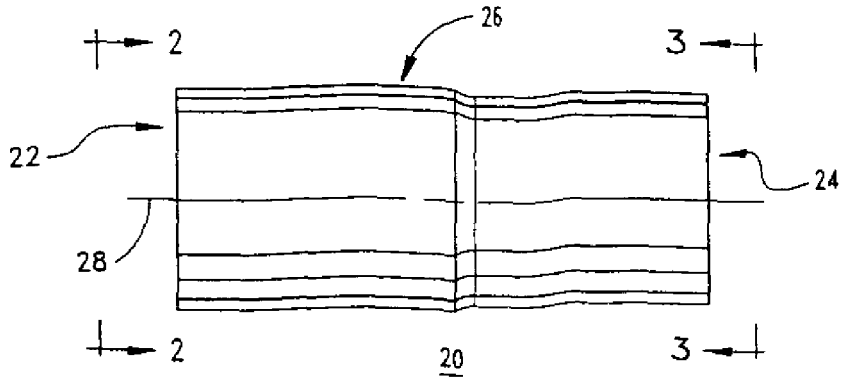
FIG. 2
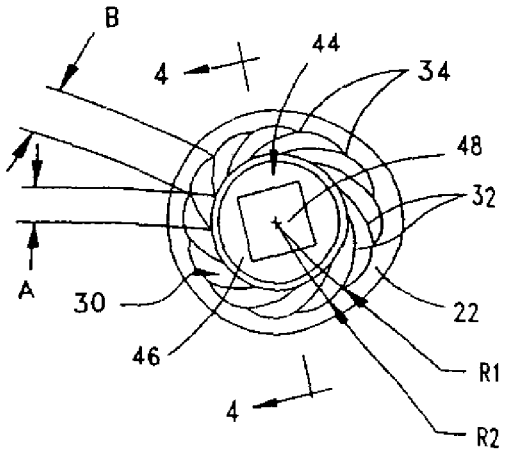
FIG. 3
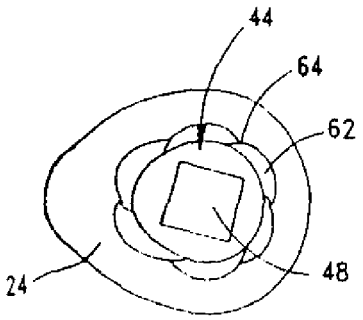
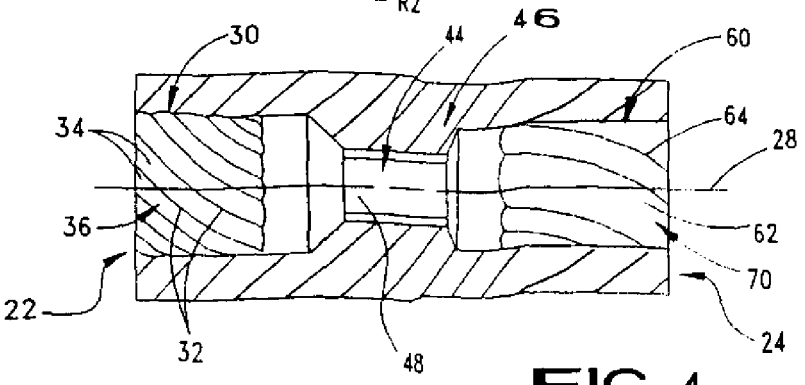
FIG. 4

UNITED STATES PATENT AND TRADEMARK OFFICE

CERTIFICATE OF CORRECTION

PATENT NO. : 6,729,208 B1
APPLICATION NO. : 10/282477
DATED : May 4, 2004
INVENTOR(S) : Joe Chrzanowski It is certified that error appears in the above-identified patent and that said Letters Patent is hereby corrected as shown below:

Delete title page and substitute therefor the attached title page.

Delete Drawing Sheets 1-3 and substitute therefor the attached Drawing Sheets 1-2.

This certificate supersedes the Certificates of Correction issued August 31, 2004, November 30, 2004, and June 5, 2007.

Signed and Sealed this

Third Day of February, 2009

John Doll

JOHN DOLL
*Acting Director of the United States Patent and Trademark Office*

(12) United States Patent
Chrzanowski

(10) Patent No.: US 6,729,208 B1
(45) Date of Patent: May 4, 2004

(54) TOOL FOR REMOVING FASTENERS

(75) Inventor: Joe Chrzanowski, Tomah, WI (US)

(73) Assignee: AJ Manufacturing Co., Inc., Elmhurst, IL (US)

( * ) Notice: Subject to any disclaimer, the term of this patent is extended or adjusted under 35 U.S.C. 154(b) by 0 days.

(21) Appl. No.: 10/282,477

(22) Filed: Oct. 29, 2002

(51) Int. Cl.[7] ..... B25B 13/50
(52) U.S. Cl. ..... 81/53.2; 81/121.1; 81/120
(58) Field of Search ..... 81/53.2, 120, 121.1, 81/124.6, 125, 186

(56) References Cited

U.S. PATENT DOCUMENTS

| | | | | |
|---|---|---|---|---|
| 906,040 | A | 12/1908 | Lucas | |
| 1,478,736 | A | 12/1923 | Gadberry | |
| 1,590,200 | A | 6/1926 | McGuckin | |
| 2,391,624 | A | 12/1945 | Heuer | |
| 2,896,985 | A | 7/1959 | Braatz | |
| 3,079,819 | A | 3/1963 | Wing | |
| 3,125,910 | A | 3/1964 | Kavalar | |
| 3,161,090 | A | 12/1964 | McLellan | |
| 3,675,516 | A | 7/1972 | Knudsen et al. | |
| 3,788,169 | A | 1/1974 | Nakayama | |
| 3,885,480 | A | 5/1975 | Muenchinger | |
| 3,903,764 | A | 9/1975 | Andersen | |
| 3,996,819 | A | 12/1976 | King | |
| 4,328,720 | A | 5/1982 | Shiel | |
| 4,452,060 | A | 6/1984 | Kanamaru et al. | |
| 4,598,616 | A | 7/1986 | Colvin | |
| 4,611,513 | A | 9/1986 | Young et al. | |
| 4,671,141 | A | 6/1987 | Hanson | |
| 4,724,730 | A | 2/1988 | Mader et al. | |
| 4,862,976 | A | 9/1989 | Meek | |
| 4,882,957 | A | 11/1989 | Wright et al. | |
| 4,930,378 | A | 6/1990 | Colvin | |
| 4,947,712 | A | 8/1990 | Brosnan | |
| 5,012,706 | A | 5/1991 | Wright et al. | |
| 5,048,379 | A | 9/1991 | Gramera et al. | |
| 5,207,132 | A | 5/1993 | Goss et al. | |
| 5,284,073 | A | 2/1994 | Wright et al. | |
| 5,551,320 | A | 9/1996 | Horobec et al. | |
| D398,823 | S | 9/1998 | Hsieh | |
| 5,813,298 | A | 9/1998 | Beattie | |
| 5,904,076 | A | 5/1999 | Siwy | |
| 5,910,197 | A | 6/1999 | Chaconas | |
| 5,931,064 | A | 8/1999 | Gillespie | |
| 5,960,681 | A | * 10/1999 | Anderson et al. | 81/125 |
| 6,029,547 | A | 2/2000 | Eggert et al. | |
| 6,047,620 | A | 4/2000 | Kozak et al. | |
| 6,198,049 | B1 | 3/2001 | Korinek | |
| 6,240,813 | B1 | 6/2001 | Hyatt | |
| 6,267,025 | B1 | * 7/2001 | Sand et al. | 81/53.2 |
| 6,282,994 | B1 | 9/2001 | Wei | |
| 6,321,623 | B1 | 11/2001 | Dykes et al. | |
| 6,321,625 | B1 | 11/2001 | Fernandez | |

(List continued on next page.)

*Primary Examiner*—Lee D. Wilson
(74) *Attorney, Agent, or Firm*—Thomas J. Ring; Wildman, Harrold, Allen & Dixon LLP

(57) ABSTRACT

A tool for removing threaded members, such as fasteners, damaged by corrosion or mechanical stress. The tool includes a first end and a second end opposite the first end. A generally annular body extends between the first and second ends and includes an inner wall. A drive engaging portion is positioned intermediate the first and second ends and is adapted for cooperating with a drive mechanism. A series of spiral flutes is formed along the inner wall of the annular body so as to provide a corresponding series of spiral crests extending along the inner wall. Proceeding from an end of the tool in a direction toward the drive engaging portion, the flutes and crests taper inward toward a central longitudinal axis extending through the annular body. When the tool is placed onto a fastener, the crests bite into an outer surface of the fastener to engage the fastener, thereby facilitating application of torque to the fastener to facilitate its removal.

19 Claims, 2 Drawing Sheets

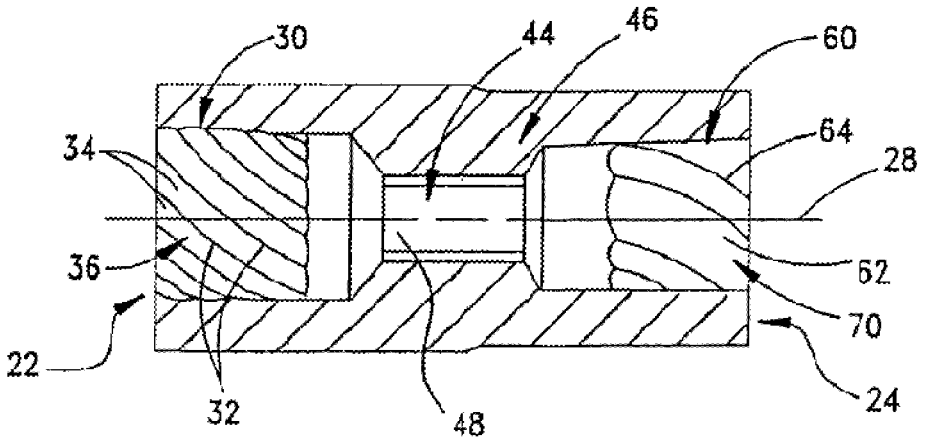

FIG. 1
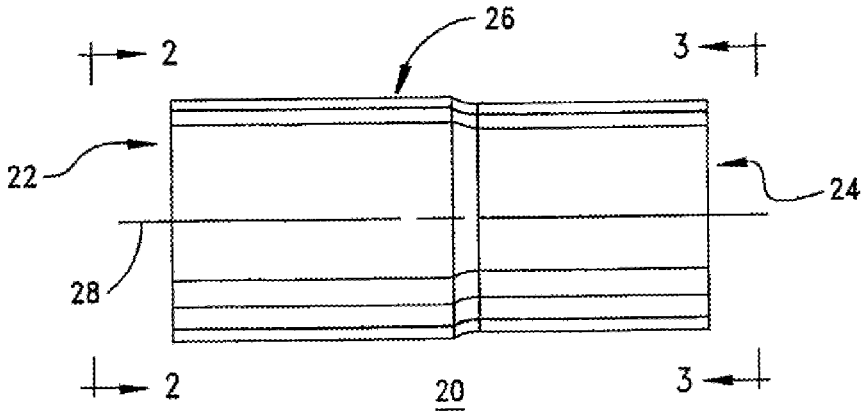
FIG. 2
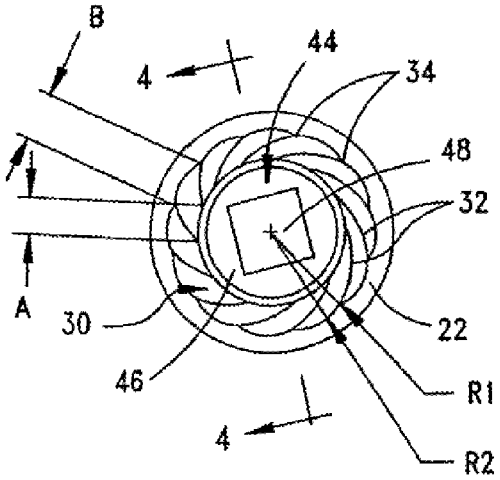
FIG. 3
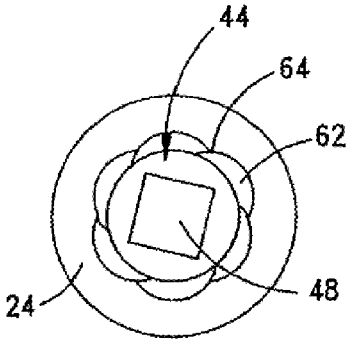
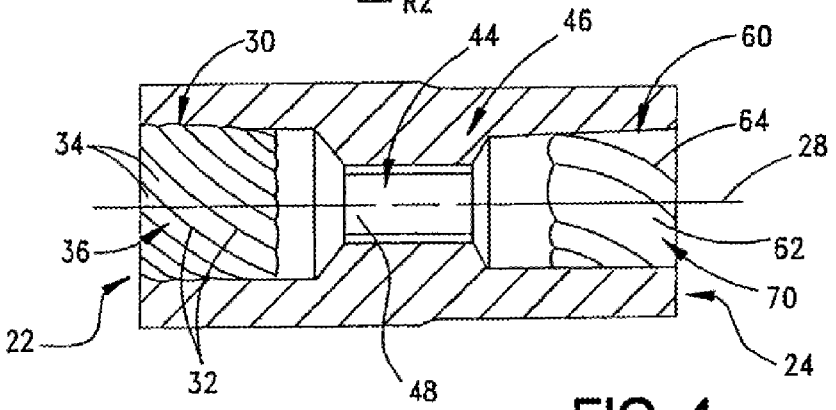
FIG. 4

FIG. 5
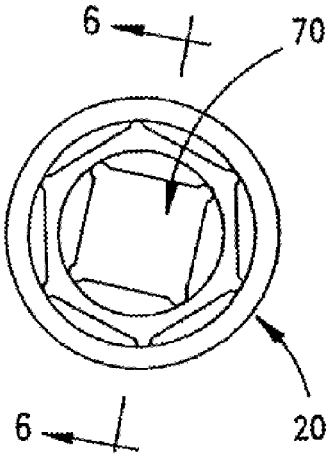
FIG. 6
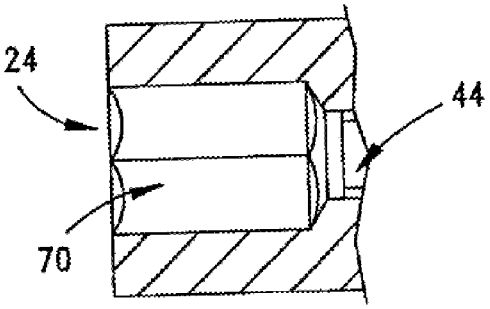
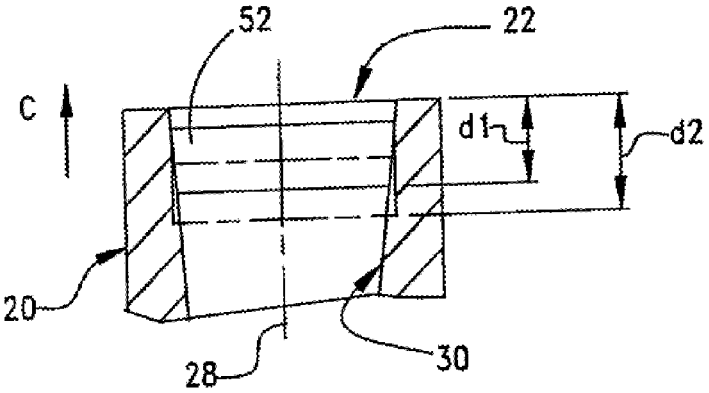
FIG. 7
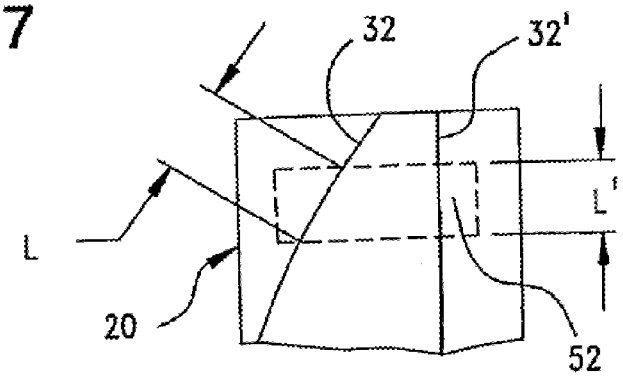
FIG. 8